United States Patent [19]

Washabaugh

[11] 4,075,272

[45] Feb. 21, 1978

[54] LADDER RUNG IMPLANTER

[76] Inventor: Edward P. Washabaugh, 401 Kelton St., Bay City, Mich.

[21] Appl. No.: 677,726

[22] Filed: Apr. 16, 1976

Related U.S. Application Data

[62] Division of Ser. No. 523,438, Nov. 13, 1974, Pat. No. 3,989,177.

[51] Int. Cl.[2] ..... B28B 1/00; B28B 23/00

[52] U.S. Cl. ..... 264/249; 264/274; 264/333; 425/126 R; 425/517

[58] Field of Search ..... 264/69, 249, 35, 274, 264/154, 333; 425/125, 126, 127, 517; 29/244, 252; 249/11, 12, 83

[56] References Cited

U.S. PATENT DOCUMENTS

| | | | |
|---|---|---|---|
| 992,782 | 5/1911 | Lambie | 249/11 |
| 2,682,703 | 7/1954 | Schob | 29/252 X |
| 2,688,175 | 9/1954 | Billner | 264/87 |
| 3,257,700 | 6/1966 | Thomas | 249/83 X |
| 3,551,967 | 1/1971 | Williams | 264/69 X |
| 3,922,133 | 11/1975 | Crawford | 425/427 X |

*Primary Examiner*—Thomas P. Pavelko
*Attorney, Agent, or Firm*—Burton, Parker & Schramm

[57] ABSTRACT

A method of mounting steps on the inner wall surface of a manhole section comprising implanting the steps in the section while the same is still green and following removal of the inner form but before removal of the outer form, positioning each step in confronting relation with the manhole section and thereupon smoothly and uniformly, without vibration and hammering, pushing the step into the concrete and compacting the concrete around the implanted step. The apparatus may be portable and shifted into the manhole section through an end thereof after the inner form has been removed but prior to removal of the outer form, and positioned against the base ring at opposite inside diameters thereof and engaging the outer form at the top of the manhole section and while thus engaged urging the step into the manhole section as aforesaid. Alternatively the apparatus may be stationary and the manhole section temporarily moved thereto and supported thereon during step implanting.

6 Claims, 12 Drawing Figures

LADDER RUNG IMPLANTER

CROSS-REFERENCE TO RELATED APPLICATION

This application and the patent maturing therefrom is a division of applicant's parent application Ser. No. 523,438, filed Nov. 13, 1974, now U.S. Pat. No. 3,989,177.

FIELD OF INVENTON

This invention relates to a method therefor mounting steps in the wall of a concrete manhole section by pushing the steps into the wall while the concrete manhole is still green.

BACKGROUND OF THE INVENTION

In the manufacture of concrete manhole sections it is necessary to provide steps in the walls of the sections to enable workmen to descend and ascend the manhole when the same has been installed in the ground. Steps of U-shaped configuration have become popular. Heretofore various methods have been utilized to fix such steps in the manhole sections. The most prevalent of the prior art methods has been for a workman to enter the green manhole section and drive the steps into place by hammering the steps into the wall of the section using a sledge. According to another method the steps are urged into the green concrete while vibrating them.

A number of disadvantages attend the prior art methods of step installation, not the least of which is the time-consuming labor of the installations. According to any of such methods it has been necessary to have a workman enter the manhole section to carry out the installation. This involves providing some means to enable him to climb up and then descend into the section. Also, none of the prior art methods provide a rapid and at the same time reliable installation.

Considering the fact that the steps in an installed manhole are often in a very damp atmosphere, and that the manhole sections may have been installed for many years in the ground before it is necessary for a workman to descend into the manhole, it is important from a safety standpoint that the steps continue to have a reliable mounting in the manhole wall and that the mounting be such as to discourage corrosion of the steps at their points of anchor in the wall.

In addition, when the steps are hammered or vibrated into place the severe pounding and vibrations necessary to effect the penetration of the step into the manhole wall tend to disturb the green concrete and cause settlement thereof and consequently adversely affect the reliability of the manhole wall itself. Also, when the step is hammered in place by a workman, there is a problem of insuring that the step has been driven into the wall far enough to effect a long-life anchor and yet has not been driven so far through the wall as to give rise to infiltration of surrounding water which, if the same occurs, could lead to early failure of the step installation if not the manhole section itself.

SUMMARY OF THE INVENTION

According to the method aspect of this invention the steps to be implanted are provided with parallel projections or arms having at their free ends or elsewhere thereon enlarged portions of the like. Each step is positioned with the free ends of its arms confronting the green concrete wall surfaces and is then smoothly and uniformly, and without hammering and vibration, pushed into the green concrete wall to a depth burying the enlarged portions in the wall. The concrete is then compacted around the embedded arms of the step. No vibration or hammering is associated with the implant tending to disturb the green concrete.

According to the apparatus aspect of the invention a step holder is supported for determined lateral displacement by a fluid pressure cylinder. The holder is carried by a structure which is located relative to the manhole section by engagement with portions of the casting form. In particular the structure engages the base ring across a diameter thereof and also engages the outer form at the top thereof. When thus located, the holder is laterally shifted under influence of the hydraulic cylinder to press the arms of the step smoothly and uniformly into the green concrete wall. In one form of the apparatus it is mounted for shiftable movement into and out of the green manhole section through one end of the section.

According to another form of the apparatus, there is a base portion with an upstanding support carrying laterally shiftable step holders which are moved by fluid pressure cylinders. The green manhole section is brought to the apparatus and set down on the base portion and the step carriers are shifted laterally to smoothly implant the steps in the section wall.

DESCRIPTION OF THE PREFERRED EMBODIMENTS

Figure 1:
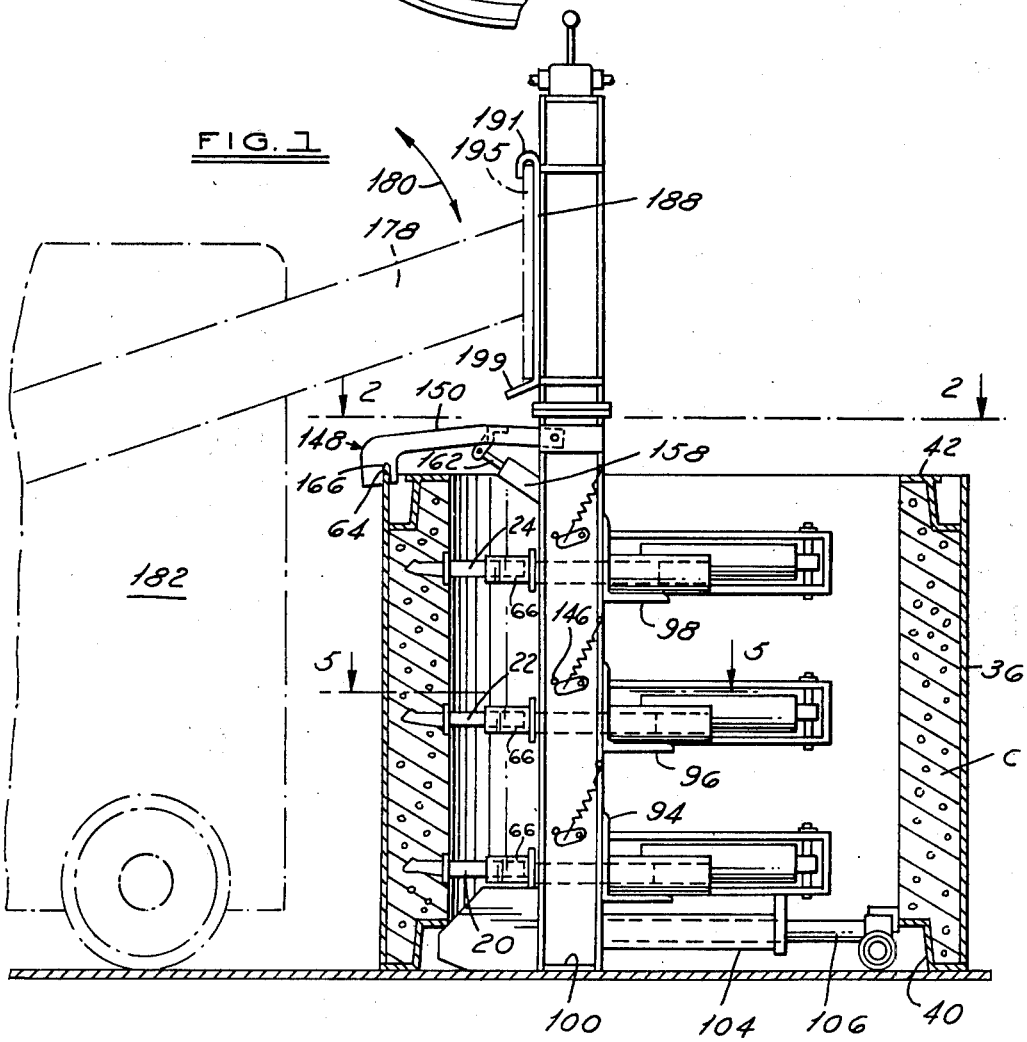
FIG. 1 is a vertical cross-sectional view through a manhole section showing in side elevation one form of the step implanting apparatus with three steps implanted in the wall.
Figure 5:
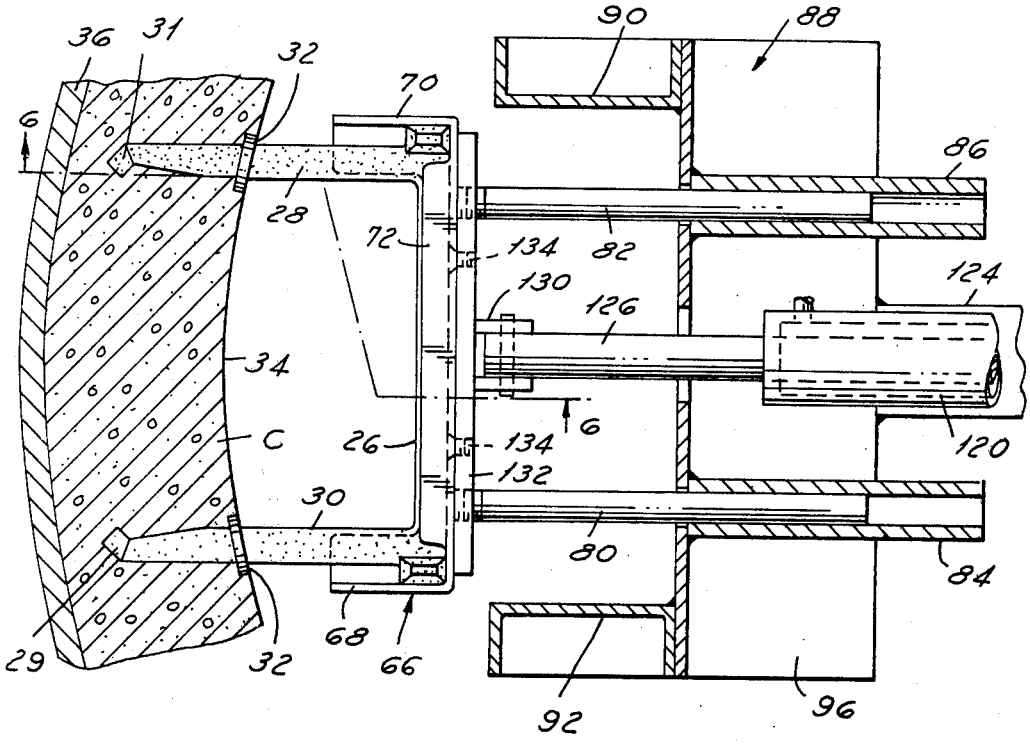
FIG. 5 is a cross-sectional view taken on the line 5—5 of FIG. 1.
Figure 7:
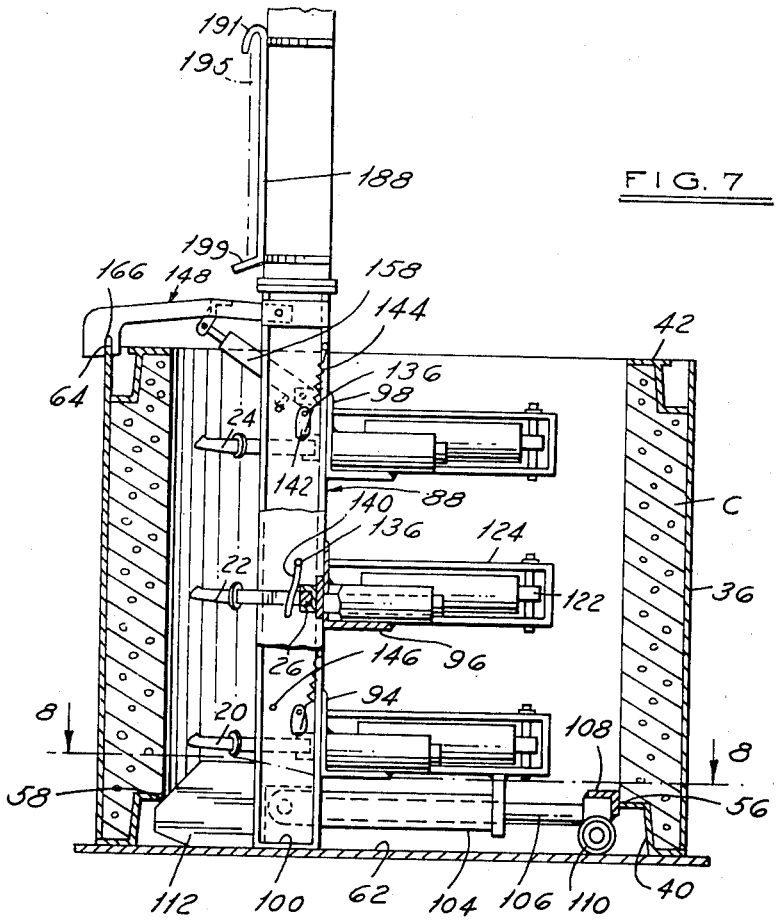
FIG. 7 is a side elevation similar to FIG. 1 but showing the step carriers prior to implanting the steps in the manhole wall.

In FIG. 1 three steps 20, 22 and 24 are shown immediately after implant in a green concrete manhole wall, while in FIG. 7 the steps have not yet been but are ready to be implanted. As shown in FIGS. 1, 5 and 7 each step includes a tread portion 26 and a pair of parallel arms 28 and 30 integral with the tread portion. Each arm may have a depth flange 32 whose function is to compact the green concrete about the leg after it has been implanted. Actually the compacting occurs during the last increments of inward implanting motion of the step as the depth ring is buried flush with the green concrete wall surface.

In carrying out the method aspect of the invention, a concrete manhole section is first cast between outer and inner forms. The inner form is stripped out while the concrete is still green leaving the outer form 36 surrounding the green section. A base ring 40 defining the hub end of the section underlies the outer form 36. An upper spigot-defining ring 42 is at the top of the section.

Figure 11:
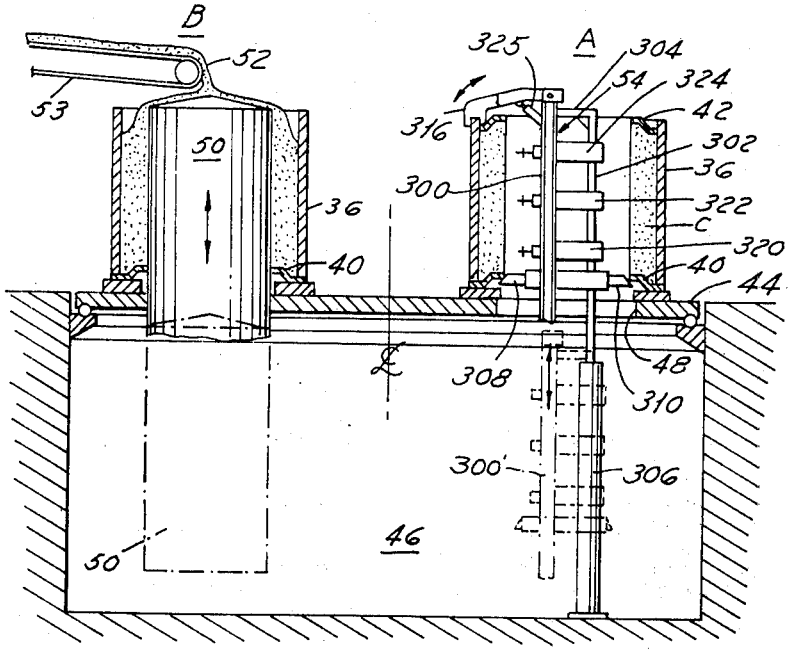
FIG. 11 is a vertical section through a packer head incorporating the step implanter.
Figure 12:
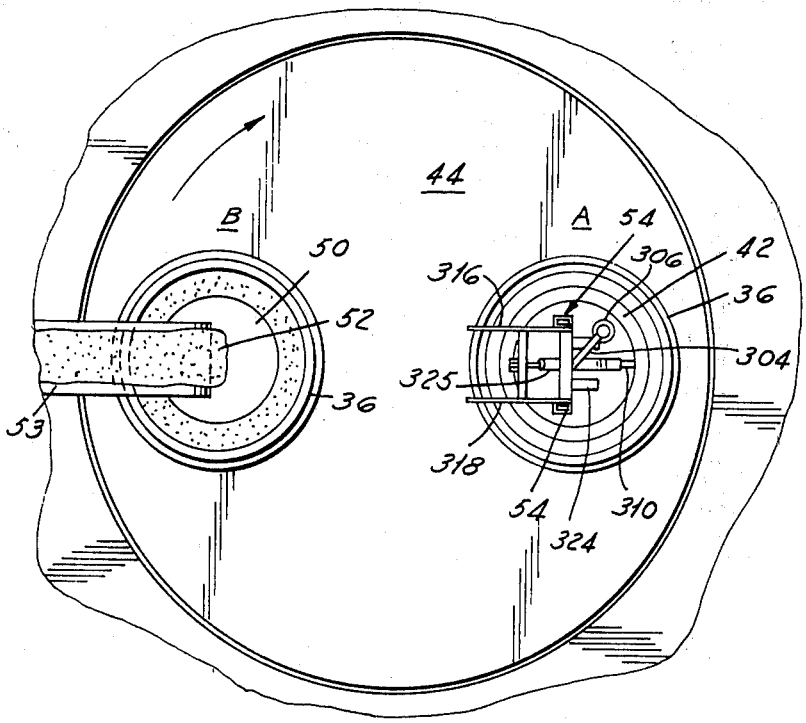
FIG. 12 is a plan view of the apparatus of FIG. 11.

In high production casting plants the manhole sections may be cast in a packer head machine schematically shown in FIGS. 11 and 12. The packer head is conventional equipment and therefor is not described in detail. Suffice it that the packer head machine includes a turntable 44 positioned above a pit 46 in the floor of the plant. The base ring 40 and outer form 36 are positioned over a circular opening 48 in the turntable at a loading station A in FIG. 11. The table is then rotated to carry the form and ring to casting station B where the inner form 50 is shifted upwardly from the pit 46 through the opening 48 in the table and the base ring 40 to be located concentrically with the outer form 36. The pre-mixed concrete is then poured as at 52 from delivery means 53 onto the top of the inner form 50 and through rotating mechanism, not shown, is swept into the cylindrical cavity between the concentric forms and the concrete is subjected to vibration to compact it, and when the space is essentially filled the top ring 42 is applied and the casting of the manhole section completed.

During the casting at station B, another base ring and outer form may be mounted on the turntable at station A preparatory to movement to station B. When the casting is completed the inner form 50 is withdrawn downwardly into pit 46 to strip it from the green concrete section, and the turntable is rotated to bring the green concrete section C back to station A as shown in FIG. 11. At station A the green manhole is removed to permit placement of another form 36 and base ring. Either before or after removal the manhole steps are implanted. Mechanism generally indicated at 54 at station A is schematically shown for implanting steps in the green concrete manhole wall before removal of the green section from the packer head. Description of such mechanism will follow the description of step implanting mechanism shown In FIGS. 1–10 which implants steps after removal of the green section from the packer head turntable.

Whether the manhole sections are cast in a packer head machine or whether they are cast according to some other method, they are, in any event according to my improved method of implanting the steps, prepared for the implanting by having the inner casting form stripped from the section in its green state. The green section is thus enclosed by the outer casting form 36 and rests on the base ring 40. The top ring 42 may also be left in place to insure accurate shape of the spigot end. In the green condition contemplated by this invention the concrete is still workable but is sufficiently dry so that it is reasonably self supporting. It is in such condition that the outer form may be removed and the manhole section will not sag. There is, of course, a conventional wire cage reinforcement within the section and this helps to render it self supporting while in the green condition.

Figure 2:
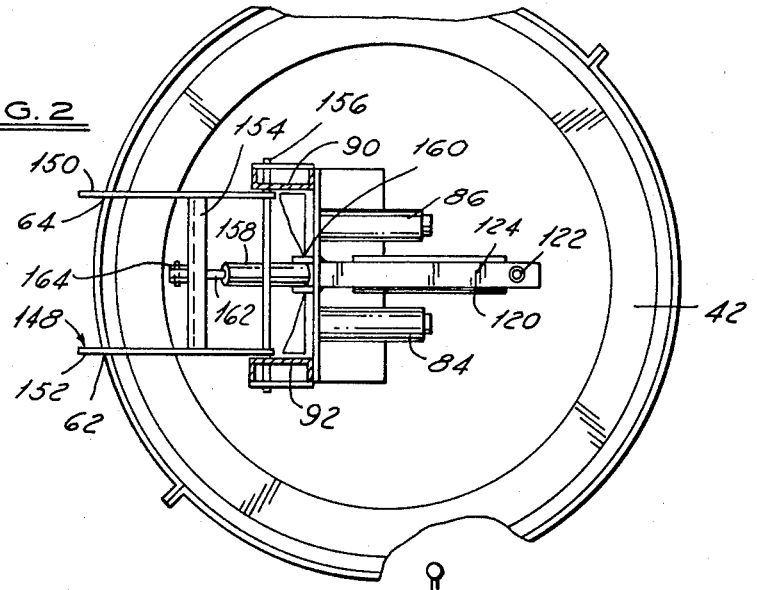
FIG. 2 is a top elevation taken on the line 2—2 of FIG. 1.

However, the method aspect of the invention is carried out while the outer form is in place. The ladder step (or steps) to be implanted is positioned within the green concrete manhole section by reference to the casting form structure and each is disposed in a plane perpendicular to the axis of the manhole. Essentially the positioning is by reference to the inside and bottom of the base ring as, for example, a three point engagement with the base ring 40 as at 56, 58 and 60 in FIGS. 7 and 8, and a supporting surface 62 upon which the bottom of the base ring is resting. In addition, positioning may be further effected by engagement with the top edge of the outer form 36 as at 62 and 64 as shown in FIGS. 1, 2 and 7.

Figure 6:
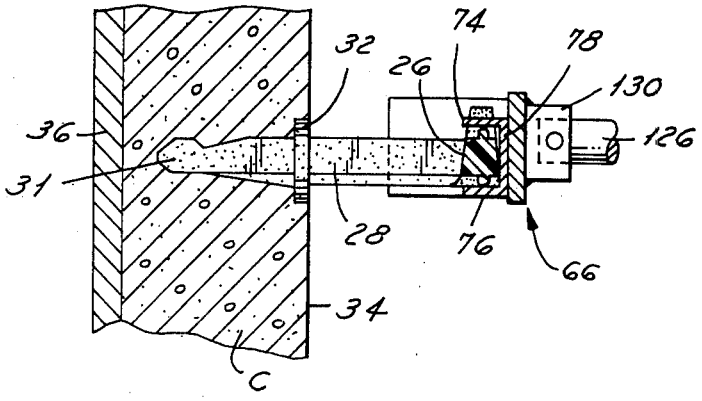
FIG. 6 is a cross-sectional view taken substantially on the line 6—6 of FIG. 5.

After a step is positioned such that it lies in a plane substantially perpendicular to the axis of the manhole and with the free ends of its arms in confronting relation with the green manhole wall, a continuous and uninterrupted force is applied to the tread portion of the step in a direction to urge the free ends of the step into the green concrete wall. The force is of a magnitude sufficient to overcome the resistance to penetration of the step. As the ends of the arms penetrate the green concrete, the depth rings move into contact with and finally are embedded in the concrete as shown in FIGS. 5 and 6. At this point application of further force is discontinued. During such embedding of the depth rings the green concrete is compacted behind the enlarged knobs or ends 29 and 31 on the free ends of the arms so that voids do not exist which would permit the steps to be loose. No hammering or vibration is involved with this implanting of the steps so that danger of sagging of the interiorly unsupported wall surface of the green concrete section is avoided.

As will become apparent from the following description, the implanting is carried out while the workmen are outside the manhole section. This avoids the necessity of having a workman climb into the manhole. In addition, the method of locating the steps by reference to the form itself enables accurate placement of the steps and avoidance of the internal reinforcing cage.

Figure 3:
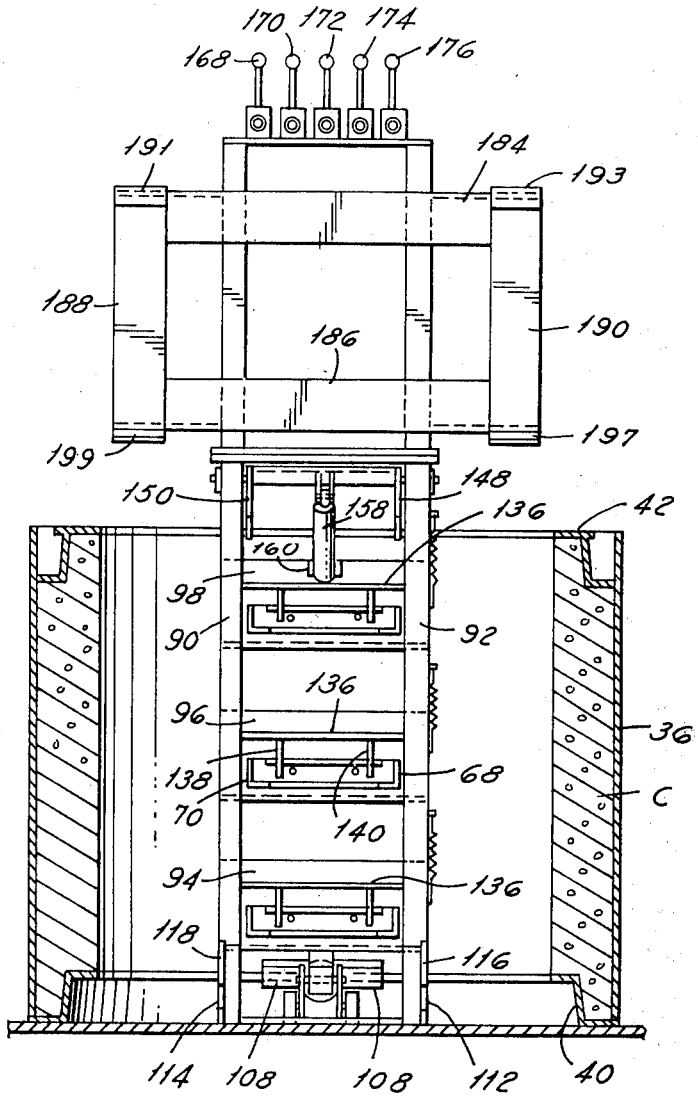
FIG. 3 is a front elevation of the arrangement shown in FIG. 1.
Figure 4:
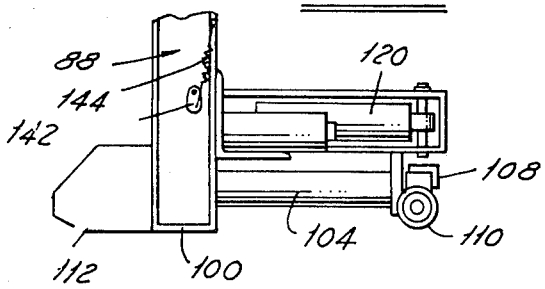
FIG. 4 is a fragmentary view of the base ring locating mechanism at the lower end of the implanter showing the same in its retracted condition.

To support and implant the steps, each is carried by a step carrier 66, three being shown in FIG. 5. As the carriers are of similar construction, a description of one will suffice for all. Each carrier is generally U-shaped in plan view with arm portions 68 and 70 connected to opposite ends of bight portion 72. Arms 68 and 70 are L-shaped in cross-section as shown in FIG. 3. The bight portion 72 is similar to the arms but throughout a major portion of its length has a horizontal overhanging wall 74, which with an opposed wall 76 and a back wall 78 defines a step receiving recess, as shown in FIG. 6, for receiving the tread portion 26 of the step. With the tread portion 26 of the step tucked into the recess and abutting the back wall 78, the step is carried as shown in FIGS. 5–7 for implanting in the green section.

Figure 8:
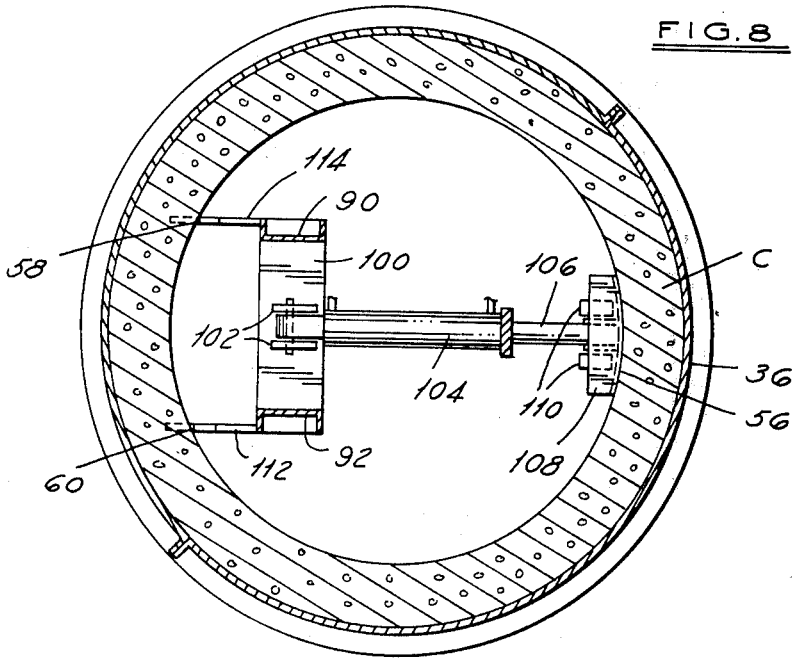
FIG. 8 is a cross-sectional view taken substantially on the line 8—8 of FIG. 7.

Each step carrier is mounted on a pair of rods 80 and 82 (see FIG. 5) slidably received in bushings 84 and 86 secured to the backside of an upstanding pillar member 88. The pillar includes a pair of spaced, vertically extending channel sections 90 and 92 secured in spaced relation by three vertically spaced angle members 94, 96 and 98 (FIGS. 3 and 7) with the bushings 84 and 86 secured to the vertical web portions thereof as shown in FIGS. 1 and 5. A bottom member 100 extends between the lower ends of the channel sections and carries a clevis 102 within which is pinned one end of a fluid pressure cylinder 104 as shown in FIGS. 7 and 8. A piston 106 projecting from cylinder 104 carries a pressure plate 108 above a pair of supporting wheels 110.

Projecting from the front side of the pillar are a pair of base ring locator plates 112 and 114 having tapered edges 116 and 118 for bearing against angularly spaced points of the base ring 40. The pressure plate 108 and locator plates 112 and 114 together define a threepoint positioning means for properly locating the pillar within the green concrete section. Upon pressurization of the cylinder 104 to extend the piston, the pressure plate 108 is extended to abut the base ring and the reaction forces the edges 116 and 118 under the base ring 40, properly centering the pillar, and wedging the locator plates beneath the base ring.

Each carrier is reciprocated by a fluid pressure cylinder 120 supported at one end 122 within a frame 124 secured to the angle members 94, 96 and 98. A piston rod 126 projecting from each cylinder passes through the angle members as shown in FIG. 5 and is pinned in a clevis 130 secured to a plate 132 to which the rods 80 and 82 are threadedly connected and the step carrier is secured as by screws 134.

Each step is temporarily retained in its carrier by a detent or retainer means. Such means comprises a transverse rod 136 for each carrier journaled in the channel sections 90 and 92 and having depending step engaging fingers 138 and 140, as shown in FIG. 3, which overlie the tread portion 26 and retain the same in the bight portion 72 of the carrier as shown in FIG. 7. Mounted on one end of each transverse rod is a throw element 142 and a spring 144 is connected to the throw and to the channel section. The points of connection of the spring to the throw and to the channel section are such, in relation to fingers 138 and 140, that when the fingers are in the position holding the step in the carrier, namely as shown in FIG. 7, the spring releasably holds the fingers against the tread portion of the step. On the other hand, when the carrier is projected to implant its step, the fingers are swung upwardly to rotate the throw into contact with the stop pin 146 and shift the over center connection whereby the spring 144 holds the fingers elevated so that they will not interfere with the implanted step upon retraction of the carrier.

The upper end of the pillar 88, as shown in FIGS. 1 and 2, includes locator mechanism 148 comprising a pair of hook-like arms 150 and 152 connected together by a cross piece 154 and pivotally mounted on a transverse rod 156 carried by the channel sections 90 and 92. A fluid pressure cylinder 158 pivotally connected at one end to a clevis 160 mounted on cross piece 98 has a piston rod 162 pivotally connected by a clevis 164 to the cross member 154. The free ends of the hook members 150 and 152 have downwardly opening slots 166 into which the upper edge of the outer form is received. Upon pressurization of cylinder 158 in one direction the arms 150 and 152 are swung upwardly from the position shown in FIGS. 1 and 7 to a release position while reverse pressurization will engage the arms with the upper edge of the outer form as shown and hold them engaged during implanting of the steps.

Control mechanism is mounted atop the pillar including, in the embodiment shown in FIGS. 1–8, five control valves having handles 168, 170, 172, 174 and 176. Each valve is connected in a fluid pressure circuit, not shown, with a source of fluid pressure and one of the fluid pressure cylinders, whereby upon the workman moving a valve handle in one direction a fluid pressure cylinder is pressurized to extend its piston while movement of the handle in the opposite direction will retract the piston.

The pillar and control mechanism shown in the FIGS. 1–8 embodiment is intended to be portable and brought to the manhole section where steps are to be implanted and then shifted into the section through the top thereof and rested on the floor 62 inside the section. For this purpose the pillar is mounted for transport on the forwardly projecting arms 178 (only one of which is shown) of a wheeled truck 182 (FIG. 1). Cross members 184 and 186 are connected to the pillar end to vertical members 188 and 190 which have hooked ends 191 and 193. The ends of arms 178 have portions 195 which are caught within the hooked ends 191 and 193 and bear against the lower ends 197 and 199 of the vertical members 188 and 190. Thus the pillar is releasably carried by the truck for movement therewith. The arms 178 are swingable along an arc 180 as shown in FIG. 1.

With a green section ready to receive the steps, the truck 182 is moved to a point thereadjacent and arms 178 swung down to shift the implanter down into the section through the top thereof. The cylinder 104 is then pressurized by shifting one of the valve handles 168–176 to extend piston rod 106 and thereby seat the pressure pad 108 against the bottom ring and shift the locator plates 112 and 114 to seat them against the opposite side of the bottom ring and wedge them therebeneath. The pillar now extends upwardly parallel to the axis of the manhole section and steps positioned in the carriers are in "squared" relation with the opposed wall of the section. Further positioning is afforded by actuating another of the valve handles 168–176 to pressurize the cylinder 158 and cause the hooks 150 and 152 to engage the upper edge of the outer form as above mentioned. If desired, the outer form may be marked at its upper edge or otherwise to indicate where the vertical wires of the reinforcing cage are located and the pillar and hooks are so positioned as to avoid forcing a step into the cage wires.

Assuming a step is disposed in each of the carriers, the remaining three valve levers are successively activated to implant successively each of the steps as before described. Following implant the carriers are retracted, the pressure plate retracted to the FIG. 4 position, the hook arms raised, and the arms 178 swung upwardly to lift the implanter out of the green section. The concrete is then cured and the steps are thus permanently mounted in the cured wall.

Figure 10:
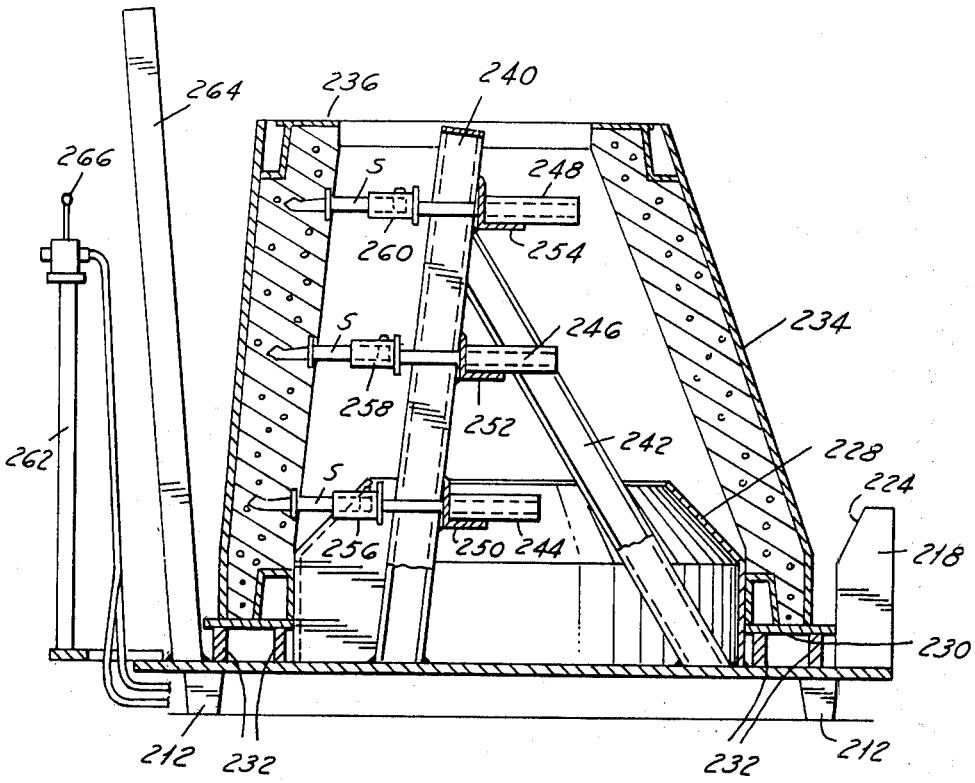
FIG. 10 is a vertical cross-sectional view of the implanter apparatus of FIG. 9 taken substantially on the line 10—10 thereof.
Figure 9:
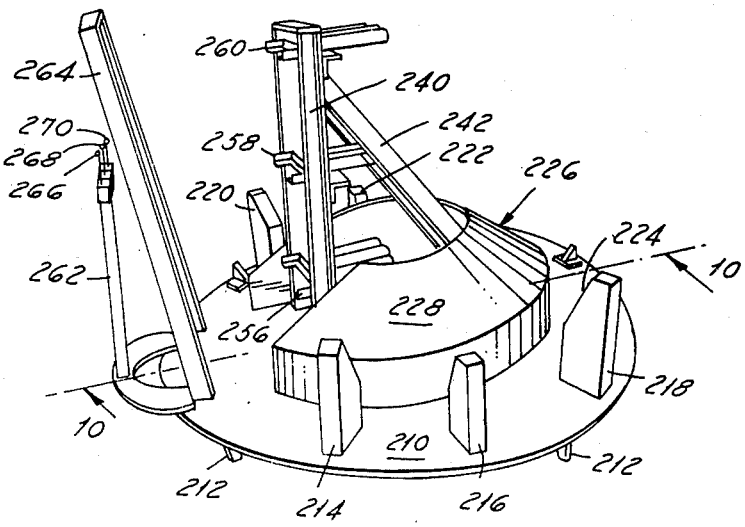
FIG. 9 is a perspective view of a step implanter particulary suitable for use with cone-shaped manhole sections.

The implanter shown in FIGS. 1–8 inclusive is particulary intended for implanting steps in green concrete manhole sections as they are brought to the curing area from the packer head. FIGS. 9 and 10 show a step implanter which is essentially stationary and the green manhole sections are brought to it, the steps implanted, and then the green section is moved away to a curing station. The mechanism of FIGS. 9 and 10 is designed for use with cone shaped manhole sections, or reducer sections. As the implanter of FIGS. 9 and 10 is in many respects similar to the implanter of FIGS. 1–8, and in view of the detailed description of the implanter of FIGS. 1–8, much of the detail of FIGS. 9 and 10 can be omitted. The implanter includes a circular base 210 supported on short legs 212. A series of locator plates 214–22 are secured to the base 210 in upstanding relation, each having a tapered face 224. The locator plates surround in spaced relation a central locator hub 226 having a downwardly outwardly sloping guiding face 228 which in cooperation with the tapered faces 224 guide the lower end of the green concrete section into nested and supported position on base plate 210 as shown in FIG. 10, ready to have the step implanted.

As shown, the base ring 230 includes spacers 232 for supporting the base ring above the floor. The outer casting form 234 rests on the base ring as shown. A top ring 236 holds the spigot end of the green section in proper shape. As with the method previously described, the inner form has been stripped from within the section leaving the green inside wall surface exposed.

Upstanding from the base plate 210 is a pillar 240 having a back brace 242. A series of fluid pressure cylinders 244, 246, and 248, secured to traverse angle members 250, 252 and 254 which are in turn attached to the pillar, have piston rods with U-shaped step carriers 256, 258 and 260 on the ends thereof. A control pedestal 262 upstands from an edge of the base plate 210, protected from damage by a bumper member 264. Atop the pedestal are three fluid pressure control valves connected in circuits between a source of fluid pressure, not shown, and the cylinders 244, 246 and 248, with the valves having manual control levers 266, 268 and 270.

In order to implant the steps S, the green concrete section encased in the outer form 34 and resting on the bottom ring 230 and with the top ring 236 in place, is set down over the hub 226 and rested between it and the locator plates. When thus positioned, the operator successively actuates the control levers 266, 268 and 270 to cause the fluid pressure cylinders to be successively actuated and thereby smoothly, and without hammering or vibration, pushed into the green section until reaching the positions shown in FIG. 10. Thereupon the levers 266–270 are shifted to cause retraction of the step carriers 256, 258 and 260. The manhole section is now lifted off the implanter and removed to a curing station.

As before mentioned, FIGS. 11 and 12 show mechanism for implanting the steps before they are removed from the packer head. Details of the mechanism are omitted because such will be similar to those heretofore described and also will vary with requirements of the particular installation. A pillar member 300 is carried by a vertical piston rod 302 on a bracket 304, with a fluid pressure cylinder 306 shifting the rod, and consequently the pillar selectively vertically upwardly into a green concrete section C on the turntable or withdrawing the same downwardly to the phantom outline position 300'. Mounted at the lower end of the pillar are laterally extending locator plates 308 and 310 similar to locator plates 112 and 114 which engage beneath the lower inner edge of the base ring to locate the pillar relative thereto. At the upper end of the pillar are swingable hook-like arms 316 and 318 similar to arms 148 and 150. Arms 316 and 318 hook over the upper edge of the outer form 36 in like fashion to arms 148 and 150 and serve to position and hold the upper end of the pillar in proper position relative to the green concrete section C.

Mounted on the pillar 300 are transverse fluid pressure cylinders 320, 322 and 324 each connected to a step carrier similar to the arrangement shown in FIGS. 1–8 or 9 and 10. Suitable fluid pressure circuitry, not shown, is connected to each of these cylinders and to the vertical cylinder 306 for operating them. In addition, a fluid pressure actuator 325 similar to 158–162 of FIGS. 1–3 may be connected between arms 316 and 318 and the pillar 300 to swing the arms and lock them in position.

With the implant mechanism 54 in the solid outline position of FIG. 11, the machine operator pressurizes the cylinders 320, 322 and 324 to push the steps carried thereby into the green concrete wall in the same fashion as heretofore described in connection with the embodiments of FIGS. 1–10. Thereafter the step carriers are retracted, the arms 316 and 318 are unhooked and the mechanism lowered into the packer pit to the phantom outline position 300' shown in FIG. 11. The implanting step at station A may be carried out while casting a section at station B. Following implanting the concrete section C is removed from the turntable and an empty outer form and base ring positioned on the turntable, the turntable rotated and the entire operation repeated.

What is claimed is:

1. The method of casting concrete manhole sections and implanting steps therein comprising positioning a base ring and an outer form on a turntable, rotating the turntable to bring the base ring and outer form to a casting station, extending an inner form upwardly through the base ring in concentric relation with the outer form, pouring concrete between the forms and casting the section therebetween, withdrawing the inner form from the green concrete section, rotating the turntable to another position, extending upwardly through the base ring and the green section step implanting means including a laterally shiftable step carrier, locating the implanting means against the base ring and upper edge of the outer form, shifting the carrier to implant a step carried thereby into the green concrete section, withdrawing the implanting means downwardly out of the green section, and removing the ring and outer form and the green manhole section from the turntable to a place for curing.

2. The invention defined by claim 1 characterized by casting another manhole section at the casting station while implanting a step as aforesaid.

3. The method of casting concrete manhole sections and implanting steps therein comprising positioning a base ring and an outer form on an off-centered part of a turntable, rotating the turntable to bring the base ring and outer form to a casting station, raising an inner form upwardly through the base ring in spaced apart concentric relation with the outer form, pouring concrete between the forms and casting the section therebetween, withdrawing the inner form from the green concrete section, rotating the turntable to another position, raising a step implanting means including a laterally shiftable step carrier upwardly through the base ring and the green concrete section, locating the step implanting means against the base ring and upper edge of the outer form, employing a continuous and uninterrupted force from a power source to the step carrier to shift the same in the direction to implant a step carried thereby into the green concrete section, withdrawing the step carrier and lowering the implanting means downwardly out of the green concrete section, and removing the ring and outer form and the green manhole section from the turntable to a place for curing.

4. The invention set forth in claim 3 wherein the extent of the penetration of the step into the green concrete wall of the manhole is determined by a depth flange carried by the step and wherein the continuous and uninterrupted force is continued to be applied to the step following the abuttment of the depth flange with the inner wall surface of the manhole section to forcibly embed the depth flange in the surface of such wall thus compacting the green concrete immediately surrounding the penetrated portion of the step.

5. The method of affixing a manhole step having at least one projecting arm for embedment in a green concrete wall of a manhole comprising: positioning the step to be affixed so that the free end of the arm is disposed in confronting relation with the green concrete manhole wall and such that the plane of the step is substantially perpendicular to the axis of the manhole, applying a continuous and uninterrupted force exerted by a power source to the step in the direction to urge the arm into the green concrete wall and of a magnitude sufficient to overcome the resistance of penetration of the arm thereinto with the result that the arm is advanced into the wall in a continuous and uninterrupted manner, continuing the application of such uninterrupted force until the arm of the step has penetrated the green concrete wall to a depth represented by the abuttment of a depth ring carried by the arm with the inner surface of such wall, and further continuing the application of such force to the step to forcibly embed the depth ring in such surface of the wall thus compacting the green concrete immediately surrounding the penetrated portion of the arm.

6. The method of casting concrete manhole sections and implanting steps therein comprising positioning a base ring and an outer circular form on an off-centered part of a turntable, rotating the turntable to bring the base ring and outer form to a casting station, moving an inner form into spaced apart substantially concentric relationship with the outer circular form, pouring concrete between the inner and outer forms and casting a manhole section therebetween, withdrawing the inner form from the green concrete manhole section, rotating the turntable to another position, moving a step implanting means including a laterally shiftable step carrier into the area encompassed by the green concrete manhole section, locating the step implanting means against the base ring and upper edge of the outer form, employing a continuous and uninterrupted force from a power source to the step carrier to shift the same laterally in the direction to implant a step carried thereby into the green concrete manhole section, withdrawing the step implanting means including the step carrier out of the green concrete manhole section, and removing the green manhole section from the turntable.

* * * * *